US006478594B1

(12) United States Patent
Curtin et al.

(10) Patent No.: US 6,478,594 B1
(45) Date of Patent: Nov. 12, 2002

(54) ELECTRICAL CONNECTOR FOR RECEIVING ELECTRICAL PLUG

(75) Inventors: Peter Thomas Curtin, Rahen (IE); Dave Hannon, Tuam (IE); Damien O'Sullivan, Kanturk (IE)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/901,285

(22) Filed: Jul. 9, 2001

(51) Int. Cl.[7] ..... H01R 29/00
(52) U.S. Cl. ..... 439/188
(58) Field of Search ..... 439/188, 607, 439/609, 668, 318, 218, 326–328, 108

(56) References Cited

U.S. PATENT DOCUMENTS

| | | | | | |
|---|---|---|---|---|---|
| 4,165,147 | A | * | 8/1979 | Buck | 439/188 |
| 4,392,708 | A | | 7/1983 | Bailey et al. | |
| 4,548,447 | A | | 10/1985 | Dinsmore | |
| 4,655,535 | A | | 4/1987 | Kysiak | |
| 4,820,200 | A | | 4/1989 | Lau | 439/607 |
| 5,006,675 | A | | 4/1991 | Sakaguchi | 200/51.09 |
| 5,092,795 | A | | 3/1992 | Kitagawa | 439/668 |
| 5,266,042 | A | | 11/1993 | Hampel | 439/188 |
| 5,277,628 | A | | 1/1994 | Lin et al. | 439/668 |
| 5,338,215 | A | | 8/1994 | Lee et al. | 439/188 |
| 5,934,924 | A | | 8/1999 | Suzuki | 439/318 |
| 5,947,771 | A | | 9/1999 | Bethurum | 439/668 |
| 6,056,602 | A | | 5/2000 | Wu | 439/668 |
| 6,062,885 | A | * | 5/2000 | White | 439/188 |
| 6,077,126 | A | | 6/2000 | Peng | 439/668 |
| 6,093,058 | A | * | 7/2000 | Wu | 439/607 |
| 6,116,959 | A | | 9/2000 | Taylor | 439/668 |
| 6,126,465 | A | | 10/2000 | Franks, Jr. | 439/218 |
| 6,168,448 | B1 | | 1/2001 | Chang | 439/188 |
| 6,174,187 | B1 | * | 1/2001 | Yamagami et al. | 439/326 |
| 6,220,898 | B1 | * | 4/2001 | Wu | 439/668 |
| 6,312,274 | B1 | * | 6/2001 | Lin | 439/188 |

* cited by examiner

*Primary Examiner*—Tulsidas Patel
*Assistant Examiner*—J. F. Duverne
(74) *Attorney, Agent, or Firm*—Stephen Z. Weiss

(57) ABSTRACT

An electrical connector is provided for receiving an electrical plug. The connector includes a dielectric housing having a plug-insertion cavity for receiving the electrical plug in an insertion direction. At least one conductive terminal is mounted on the housing and includes a body portion for fixing the terminal to the housing. A spring contact arm extends from the body portion toward the plug-insertion cavity. A contact portion of the spring contact arm is exposed in the cavity for engaging the electrical plug. The spring contact arm extends generally transversely of the insertion direction, whereby the contact portion is yieldably movable generally perpendicular to the insertion direction. The spring contact arm is bowed outwardly of the plug-insertion cavity near the periphery thereof, whereby only the contact portion is exposed in the cavity.

5 Claims, 4 Drawing Sheets

ELECTRICAL CONNECTOR FOR RECEIVING ELECTRICAL PLUG

FIELD OF THE INVENTION

This invention generally relates to the art of electrical connectors and, particularly, to a connector for receiving an electrical plug.

BACKGROUND OF THE INVENTION

Generally, an electrical connector typically includes some form of dielectric housing which mounts a plurality of conductive terminals. The terminals may be adapted for terminating a plurality of electrical conductors, or the connector may be adapted for mounting on a printed circuit board with the terminals having tail portions for connection to appropriate circuit traces on the circuit board. Of course, there is a wide variety of other types of electrical terminations with which electrical connectors are employed. An electrical connector typically is designed for mating with a complementary second connector or other mating connecting device, whereby the terminals of the respective connectors interengage for establishing electrical connections through the connector interface.

One type of electrical connector is a receptacle connector designed for receiving an electrical plug. Some receptacle connectors are in the form of power jacks and audio or data signal jacks which often are mounted on printed circuit boards for use in a variety of electronic equipment such as telecommunications equipment, computers and the like. Such receptacle connectors or jacks are used in cellular telephones, car phones, battery chargers, television equipment and a variety of other applications. Such receptacle connectors or jacks include one or more plug-insertion cavities for receiving electrical plugs in an insertion direction.

One of the problems with the use of receptacle connectors, such as power jacks and audio or data signal jacks, is that the terminals within the plug-insertion cavities are prone to being damaged by individuals inserting foreign objects into the connector cavity and deforming the terminals therein. A simple solution might be to remove substantial portions of the terminals away from the cavities so that they are not in line to be deformed by foreign objects inserted into the cavity. However, with the ever-increasing miniaturization of such electronic equipment, such an approach is difficult while still providing sufficient resiliency or spring action for the terminals in their engagement with the inserted electrical plug. The present invention is directed to solving these various problems by providing a receptacle connector with terminals of a unique design which provides for adequate contact resiliency yet not being prone to damage by foreign objects.

SUMMARY OF THE INVENTION

An object, therefore, of the invention is to provide a new and improved electrical connector of the character described, for receiving an electrical plug.

In the exemplary embodiment of the invention, the connector includes a dielectric housing having a plug-insertion cavity for receiving the electrical plug in an insertion direction. At least one conductive terminal is mounted on the housing and includes a body portion for fixing the terminal in the housing. A spring contact arm of the terminal extends from the body portion toward the plug-insertion cavity. A contact portion of the spring arm is exposed in the cavity for engaging the electrical plug. The spring contact arm extends generally transversely of the insertion direction, whereby the contact portion is yieldably movable generally perpendicular to the insertion direction. The spring contact arm is bowed outwardly of the plug insertion cavity near the periphery thereof, whereby only the contact portion is exposed in the cavity.

As disclosed herein, the contact portion of the terminal is convex to present a rounded contact surface exposed in the cavity for engaging the electrical plug. The housing includes a mounting slot for receiving the body portion of the terminal in a direction generally transversely of the insertion direction. Preferably, the plug-insertion cavity is elongated, and a plurality of the terminals are spaced longitudinally of the cavity.

According to one aspect of the invention, each terminal is stamped and formed of conductive sheet metal material. The body portion of the terminal is generally planar. The spring contact arm of the terminal has front and rear edges spaced relative to each other in the insertion direction, with the edges being chamfered.

According to another aspect of the invention, a contact section of the terminal is generally U-shaped to form a pair of legs. One of the legs defines the body portion of the terminal. The other leg defines the spring contact arm of the terminal.

According to a further aspect of the invention, the connector housing is adapted for mounting on a printed circuit board. The terminal(s) includes a terminating tail portion extending exteriorly of the housing for engaging an appropriate circuit trace on the printed circuit board.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
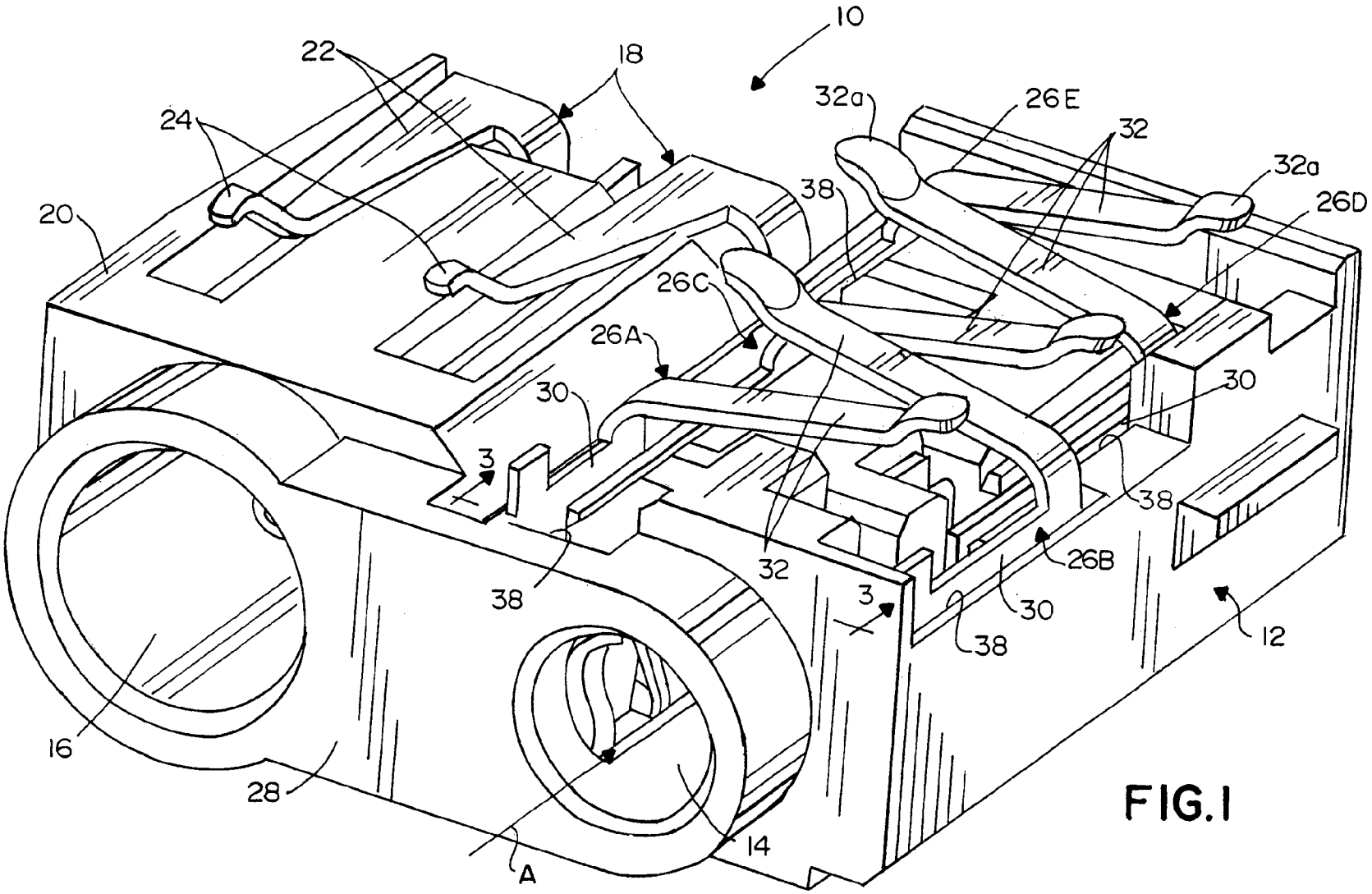
FIG. 1 is a perspective view of an electrical connector embodying the concepts of the invention.

Referring to the drawings in greater detail, and first to FIG. 1, the invention is embodied in an electrical connector, generally designated 10, for receiving an electrical plug (not shown). The connector includes a dielectric housing, generally designated 12, which may be a one-piece structure unitarily molded of plastic material or the like. Connector 10 is a receptacle connector, and housing 12 has a plug-insertion cavity 14 for receiving the electrical plug in an insertion direction indicated by arrow "A". Although the invention involves plug-receiving cavity 14 and the terminals (described hereinafter) mounted along that cavity, connector 10 also includes a second receptacle 16, with a pair of terminals, generally designated 18, associated with that receptacle. As an example, receptacle 16 may be provided for receiving a power electrical plug, while receptacle 14 may be provided for receiving an audio or signal plug.

Connector 10 and housing 12 are adapted for mounting on a printed circuit board. The housing includes a board-mounting face 20. Terminals 18 include tail portions 22 exposed exteriorly of the housing, with contact ends 24 of the tail portions adapted for engaging circuit traces, such as power circuits, on the printed circuit board.

Generally, the invention herein is centered around plug-insertion cavity 14 and a plurality of terminals mounted on housing 12 spaced longitudinally of the cavity. Specifically, five terminals are shown mounted on housing 12 longitudinally along opposite sides of cavity 14. The terminals are generally designated 26A–26E looking front-to-rear in FIG. 1, with front face 28 of connector housing 12 being the mating face of the connector.

Specifically, FIGS. 4–8 show the details of terminals 26A–26E, respectively. The terminals are substantially identical except for the length of the link arms which join the tail portions to the contact sections of the terminals, as described hereinafter. Therefore, like reference numerals have been applied in FIGS. 4–8 corresponding to like components of the respective terminals.

Figure 4:
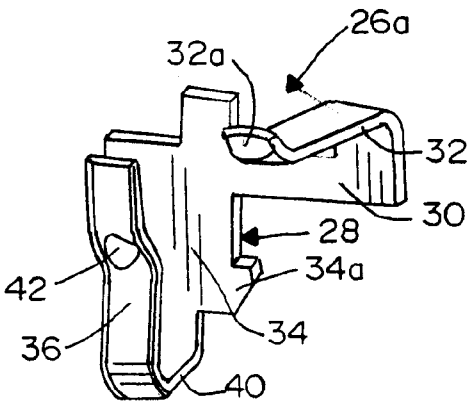
FIG. 4 is a perspective view of the first of five terminals mounted on the connector housing in a sequence as viewed from front-to-rear of FIG. 1.
Figure 5:
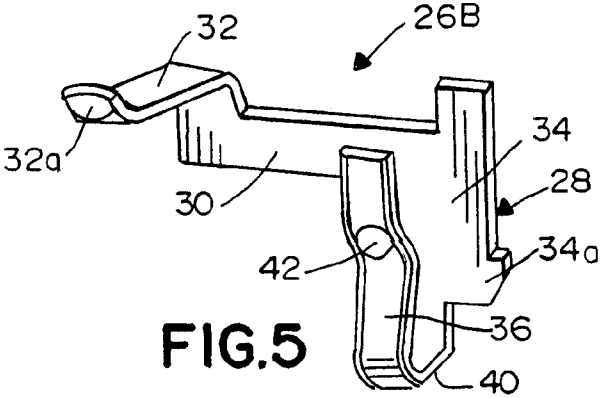
FIG. 5 is a perspective view of the second terminal.
Figure 6:
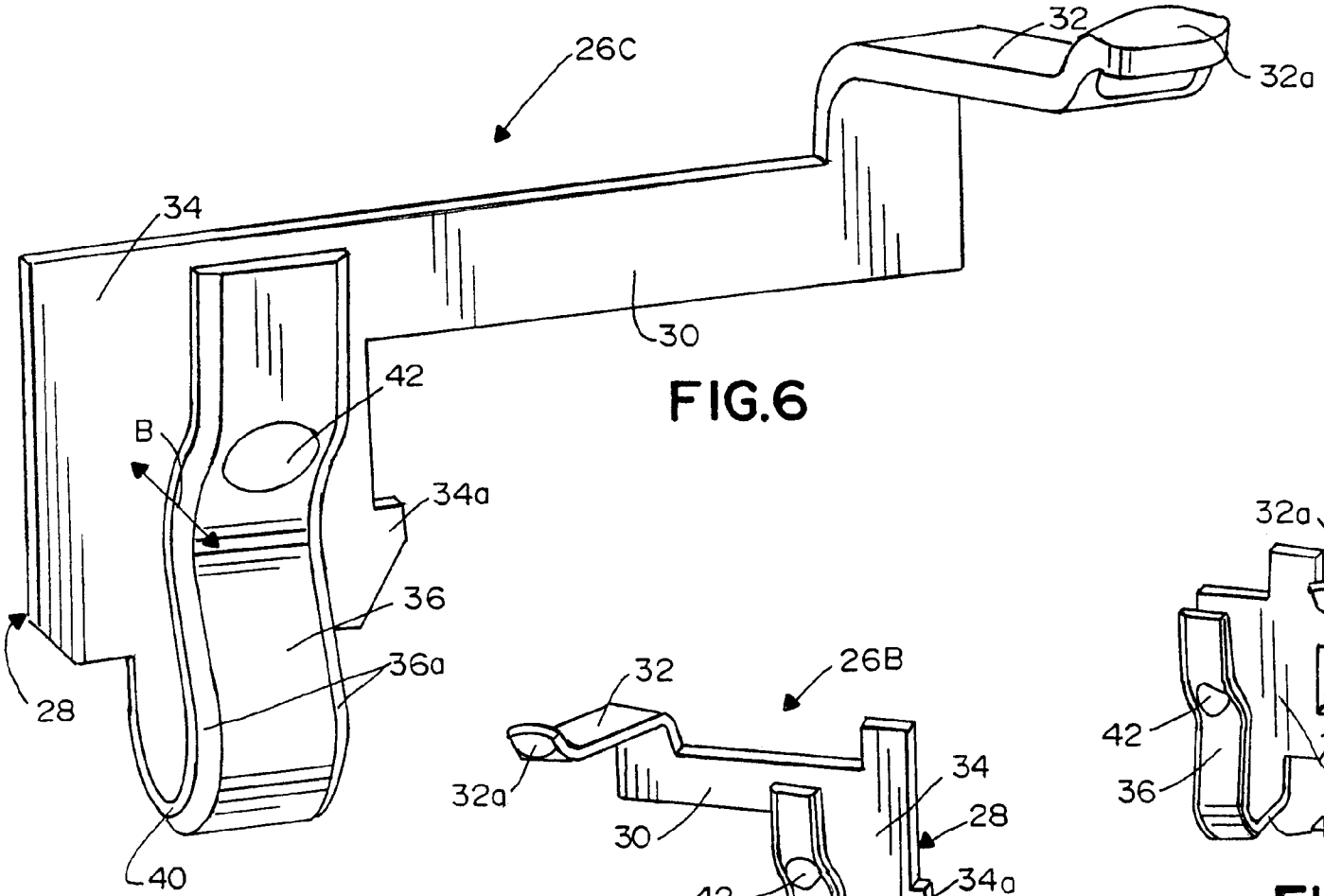
FIG. 6 is an enlarged perspective view of the third terminal.
Figure 7:
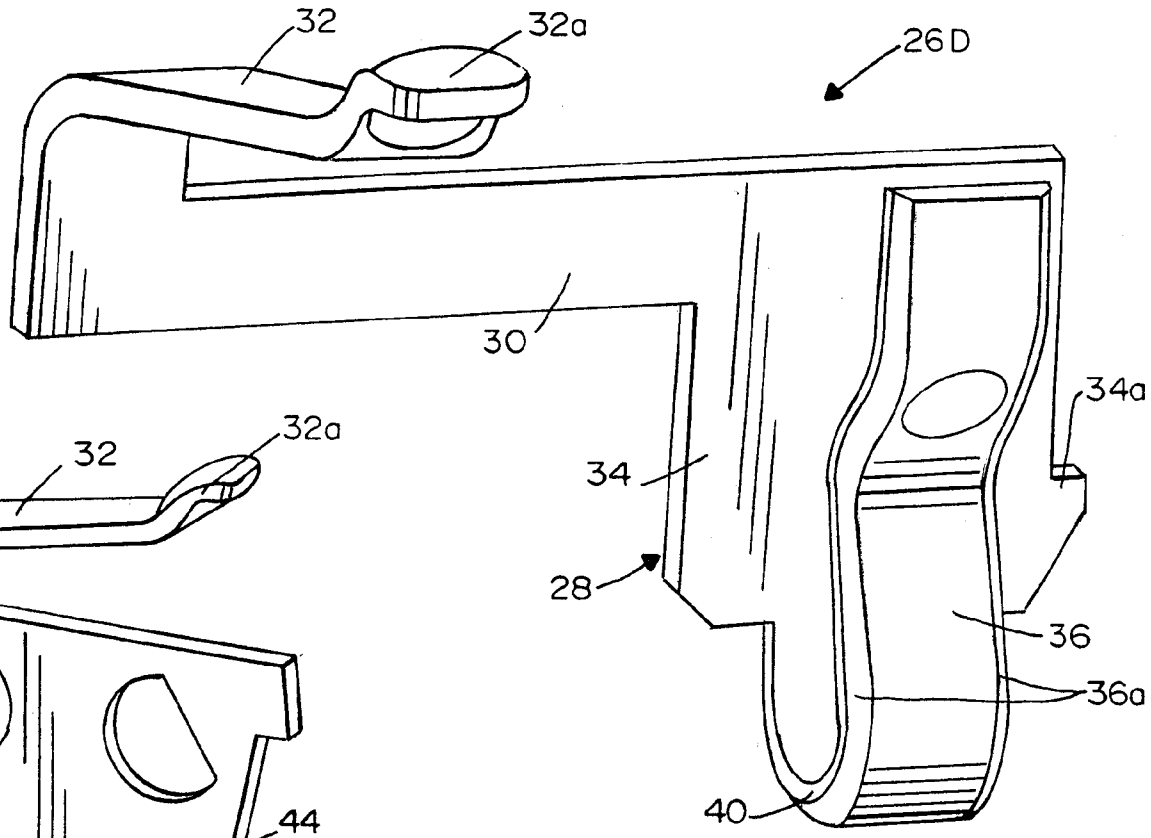
FIG. 7 is an enlarged perspective view of the fourth terminal.

Since the terminals are substantially identical, reference first will be made to FIG. 6 which shows the third terminal 26C in an enlarged depiction, rather than first terminal 26A in the smaller depiction of FIG. 4. Specifically, third terminal 26C is shown in FIG. 6 to include a contact section, generally designated 28, at one end of a link arm 30 which joins the contact section to a tail portion 32 at the opposite end of the link arm. The tail portion includes a raised distal end 32*a* for engaging an appropriate circuit trace on the printed circuit board, as tail portion 32 is exposed exteriorly of housing 12 as seen in FIG. 1.

Contact section 28 of each terminal is generally U-shaped to form a pair of legs, with one leg defining a mounting body portion 34 of the terminal and the other leg defining a spring contact arm 36 of the terminal. The terminal is stamped and formed of conductive sheet metal material, and body portion 34 is generally planar. The body portion includes a fixing tooth 34*a* for skiving into the plastic material of housing 12. In particular, the housing includes a plurality of mounting slots 38 (FIG. 1) for receiving body portions 34 of the terminals in mounting directions generally transversely of insertion direction "A". When the body portions are inserted into the mounting slots, fixing teeth 34*a* bite into the plastic material of the housing to secure or fix the terminal in position on the housing.

Spring contact arm 36 of the U-shaped contact section 28 of each terminal extends upwardly from a bight portion 40 of the contact section which joins the spring contact arm to body portion 34. The spring contact arm has a contact portion 42 which is in the form of a convex "bump" to present a rounded contact surface for engaging the electrical plug. As will be seen more clearly hereinafter, spring contact arm 36 extends generally transversely of insertion direction "A" (FIG. 1) whereby contact portion 42 is yieldably movable in the direction of arrow "B" (FIG. 6) generally perpendicular to the insertion direction. Still further, spring contact arm 36 is bowed outwardly toward body portion 34. As will be seen hereinafter, the spring contact arm effectively is bowed outwardly of plug-insertion cavity 14 (FIG. 1) near the periphery thereof, whereby only contact portion 42 is exposed in the cavity. Finally, the front and rear edges 36*a* of spring contact arm 36 are chamfered to further prevent the inserted electrical plug from damaging the terminal, particularly from deforming the spring contact arm.

Figure 8:
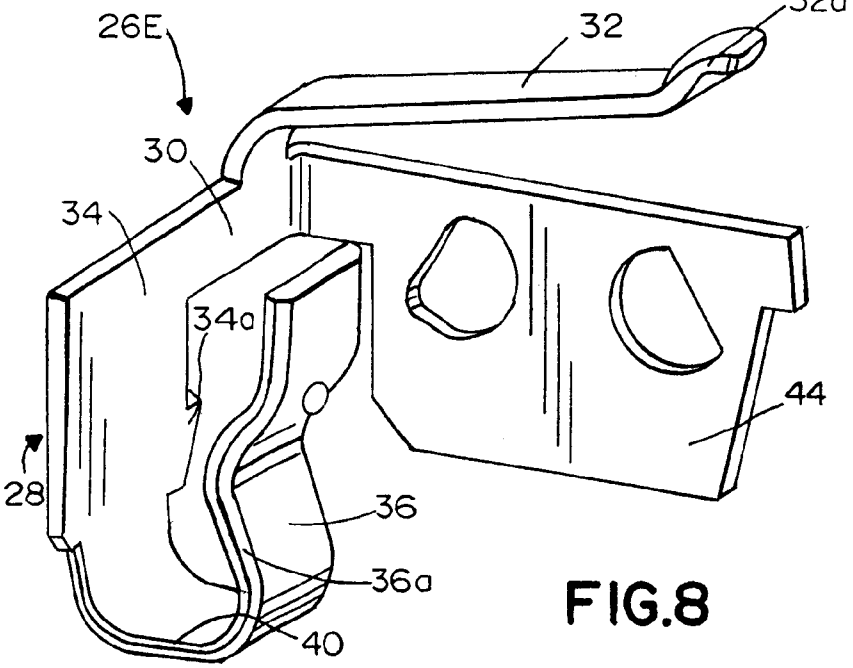
FIG. 8 is an enlarged perspective view of the fifth terminal.

With the above detailed description of the third terminal 26C in the enlarged depiction of FIG. 6, reference now can be made to the other depictions of terminals 26A, 26B, 26D and 26E shown in FIGS. 4, 5, 7 and 8, respectively. It can be seen that all five terminals are substantially identical except for the length of link arm 30 and the side of body portion 34 from which the link arm extends. Specifically, the structure and function of U-shaped contact sections 28 in all of the terminals are identical. One exception in the similarity of terminal construction is shown in FIG. 8, wherein the fifth terminal 26E has a plate 44 which extends inwardly from link arm 30 outside tail portion 32. This plate simply is formed as a shield to close the rear end of plug-insertion cavity 14 and prevent any foreign objects from being inserted thereinto.

Figure 2:
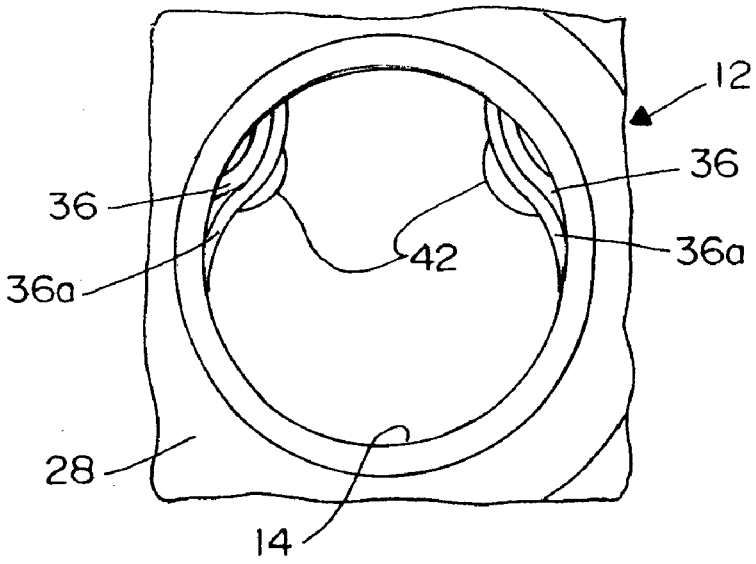
FIG. 2 is a fragmented elevational view looking into the front of the plug-insertion cavity of the connector.

With the above description of terminals 26A–26E in FIGS. 4–8, reference now is made back to FIG. 2 wherein plug-insertion cavity 14 is shown in the front or mating face 28 of connector housing 12. It can be seen that convex contact portions 42 on spring contact arms 36 essentially are the only portions of the terminals which are exposed within cavity 14. A substantial portion of each spring contact arm 36 is disposed outside the cavity so that the spring contact arm cannot be engaged by the inserted electrical plug. The majority of each spring contact arm is outwardly removed from the cavity due to the outwardly bowed configuration of the arm as described above and clearly shown in FIGS. 4–8. As seen in FIG. 2, the small portion of the spring contact arm around contact portion 42 is at the most flexible area of the arm and is further protected by the chamfered edges 36A of the arms.

Figure 3:
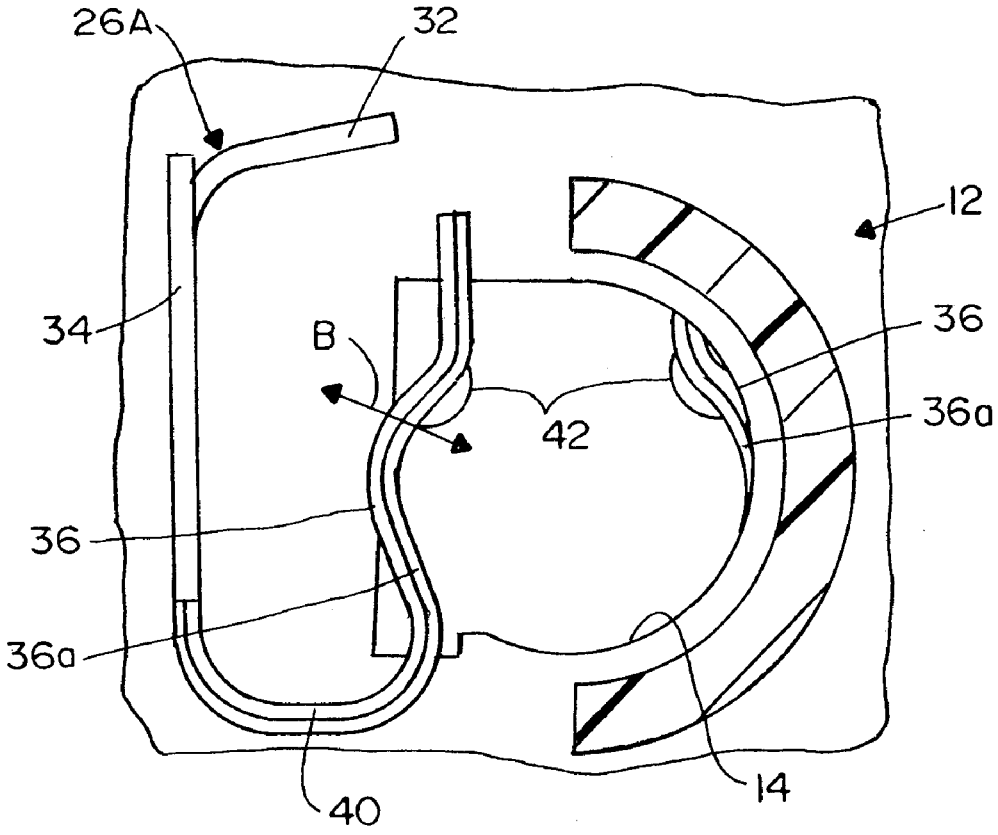
FIG. 3 is a fragmented section taken generally along line 3—3 of FIG. 1.

FIG. 3 shows terminal 26A somewhat schematically in its mounted position within housing 12. In this depiction, the outwardly bowed configuration of spring contact arm 36 is clearly visible in relation to the periphery of plug-insertion cavity 14. In this end elevational view of the terminal, it can be understood that, with only body portion 34 of the terminal being fixed in the housing, considerable flexibility is provided through bight portion 40 and spring contact arm 36 of the terminal to give considerable flexibility to contact portion 42 in the direction of double-headed arrow "B" generally perpendicular to insertion direction "A" (FIG. 1) of the electrical plug. Yet, the terminal configuration is compact and does not extend into cavity 14 due to the outwardly bowed configuration of the spring contact arm, thereby greatly reducing the possibility of damaging the terminal by the insertion of foreign objects into the cavity.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector for receiving an electrical plug, comprising:

a dielectric housing with a given width having an elongated plug-insertion cavity for receiving the electrical plug in an insertion direction and including a plurality of mounting slots in a direction generally parallel to the insertion direction, and a plurality of conductive terminals mounted in the housing, spaced longitudinally of the cavity, and including a generally planar body portion for fixing each terminal to the housing, a spring contact arm bowed outwardly of the plug insertion cavity near the periphery thereof extending from the body portion toward the plug-insertion cavity transversely of said insertion direction whereby only the contact portion on the spring contact arm is exposed in the cavity and is yieldably movable generally perpendicular to the insertion direction, a terminating tail portion integrally connected to the body portion by a planar link arm, the planar link arm located in the same plane as the body portion, the terminating tail portion extending transversely from the planar link arm exteriorly of the housing and yieldably movable generally perpendicular to the insertion direction, and the planar body portion and the planar link arm insertable in a respective one of the plurality of the mounting slots.

2. The electrical connector of claim 1 wherein the terminating tail portions of all of the conductive terminals having the same length.

3. The electrical connector of claim 2 wherein a contact section of said terminal is generally U-shaped to form a pair of legs, one of said legs defining said body portion and the other of said legs defining said spring contact arm.

4. The electrical connector of claim 2 wherein said spring contact arm having front and rear edges spaced relative to each other in said insertion direction, said edges being chamfered.

5. The electrical connector of claim 2 wherein the terminating tail portion extends across the given width of the connector housing.

* * * * *